US009764812B1

(12) United States Patent
Arbuckle et al.

(10) Patent No.: US 9,764,812 B1
(45) Date of Patent: Sep. 19, 2017

(54) SYSTEMS AND METHODS FOR SETTING ENGINE SPEED USING A FEED FORWARD SIGNAL

(71) Applicant: Brunswick Corporation, Lake Forest, IL (US)

(72) Inventors: Jason S. Arbuckle, Horicon, WI (US); William P. O'Brien, Eden, WI (US); Thomas S. Kirchhoff, Fond du Lac, WI (US); Matthew W. Snyder, Fond du Lac, WI (US); Andrew J. Przybyl, Berlin, WI (US)

(73) Assignee: Brunswick Corporation, Lake Forest, IL (US)

( * ) Notice: Subject to any disclaimer, the term of this patent is extended or adjusted under 35 U.S.C. 154(b) by 28 days.

(21) Appl. No.: 14/573,202

(22) Filed: Dec. 17, 2014

Related U.S. Application Data

(60) Provisional application No. 61/994,234, filed on May 16, 2014.

(51) Int. Cl.

| | |
|---|---|
| ***B63C 11/00*** | (2006.01) |
| ***B63H 21/20*** | (2006.01) |
| ***B63C 11/42*** | (2006.01) |
| ***B63H 21/21*** | (2006.01) |

(52) U.S. Cl.
CPC ..... *B63H 21/21* (2013.01); *B63H 2021/216* (2013.01)

(58) Field of Classification Search
None
See application file for complete search history.

(56) References Cited

U.S. PATENT DOCUMENTS

| | | | |
|---|---|---|---|
| 4,505,169 | A | 3/1985 | Ganoung |
| 4,939,660 | A | 7/1990 | Newman et al. |
| 5,080,064 | A | 1/1992 | Buslepp et al. |
| 5,171,172 | A | 12/1992 | Heaton et al. |

(Continued)

FOREIGN PATENT DOCUMENTS

| | | |
|---|---|---|
| WO | 00/68744 | 11/2000 |

OTHER PUBLICATIONS

Newport, Motion Control Coordinate System, www.newport.com, pp. 7-2 through 7-25, website visited Nov. 18, 2014.

(Continued)

*Primary Examiner* — Adam Tissot
(74) *Attorney, Agent, or Firm* — Andrus Intellectual Property Law, LLP

(57) ABSTRACT

A method for setting an engine speed of an internal combustion engine in a marine propulsion system to an operator-selected engine speed includes predicting a position of a throttle valve of the engine that is needed to provide the operator-selected engine speed, and determining a feed forward signal that will move the throttle valve to the predicted position. After moving the throttle valve to the predicted position, the method next includes controlling the engine speed with a feedback controller so as to obtain the operator-selected engine speed. The feed forward signal is determined based on at least one of the following criteria: an operator-selected control mode of the marine propulsion system; and an external operating condition of the marine propulsion system. A system for setting the engine speed to the operator-selected engine speed is also described.

17 Claims, 6 Drawing Sheets

(56) References Cited

U.S. PATENT DOCUMENTS

| | | | | |
|---|---|---|---|---|
| 5,836,851 | A | 11/1998 | Ruman | |
| 5,848,582 | A * | 12/1998 | Ehlers | F02D 7/02 123/486 |
| 6,009,371 | A | 12/1999 | Kobayashi | |
| 6,152,102 | A | 11/2000 | Ruman | |
| 6,250,292 | B1 | 6/2001 | Suhre | |
| 6,273,771 | B1 | 8/2001 | Buckley et al. | |
| 6,298,824 | B1 | 10/2001 | Suhre | |
| 6,378,506 | B1 | 4/2002 | Suhre et al. | |
| 6,425,370 | B1 | 7/2002 | Kramer | |
| 6,508,233 | B1 | 1/2003 | Suhre et al. | |
| 6,561,016 | B1 | 5/2003 | Suhre et al. | |
| 6,587,765 | B1 | 7/2003 | Graham et al. | |
| 6,701,890 | B1 | 3/2004 | Suhre et al. | |
| 6,757,606 | B1 | 6/2004 | Gonring | |
| 6,758,198 | B1 | 7/2004 | Suhre et al. | |
| 7,163,000 | B2 | 1/2007 | Ishida et al. | |
| 7,214,110 | B1 | 5/2007 | Ehlers et al. | |
| 7,357,120 | B2 | 4/2008 | Kaji | |
| 7,422,501 | B2 | 9/2008 | Mizushima et al. | |
| 7,473,149 | B2 | 1/2009 | Mizokawa | |
| 7,556,547 | B2 | 7/2009 | Kaji | |
| 7,917,283 | B2 | 3/2011 | Kado | |
| 7,976,354 | B2 | 7/2011 | Kubota et al. | |
| 8,340,847 | B2 | 12/2012 | Sako et al. | |
| 8,762,022 | B1 * | 6/2014 | Arbuckle | F02D 9/02 114/102.1 |
| 9,039,468 | B1 | 5/2015 | Arbuckle et al. | |
| 9,156,536 | B1 | 10/2015 | Arbuckle et al. | |
| 9,248,898 | B1 | 2/2016 | Kirchhoff et al. | |
| 9,381,989 | B1 | 7/2016 | Poirier | |
| 2002/0086593 | A1 | 7/2002 | Shidara et al. | |
| 2003/0000500 | A1 | 1/2003 | Chatfield | |
| 2003/0027468 | A1 | 2/2003 | Into | |
| 2003/0054704 | A1 | 3/2003 | Kanno | |
| 2003/0109184 | A1 | 6/2003 | Kanno | |
| 2003/0120360 | A1 * | 6/2003 | Yasui | F02D 35/0007 700/29 |
| 2004/0069271 | A1 | 4/2004 | Kanno et al. | |
| 2004/0069272 | A1 | 4/2004 | Allen et al. | |
| 2006/0047406 | A1 | 3/2006 | Chatfield et al. | |
| 2006/0118086 | A1 | 6/2006 | Schwulst et al. | |
| 2006/0166573 | A1 | 7/2006 | Vetta et al. | |
| 2008/0051979 | A1 | 2/2008 | Yasui et al. | |
| 2008/0280511 | A1 | 11/2008 | Kado | |
| 2009/0037073 | A1 | 2/2009 | Jung et al. | |
| 2010/0191397 | A1 | 7/2010 | Nose et al. | |
| 2011/0202258 | A1 | 8/2011 | Fukushima et al. | |
| 2011/0297462 | A1 * | 12/2011 | Grajkowski | B60K 26/04 180/54.1 |
| 2012/0191275 | A1 | 7/2012 | Clever et al. | |
| 2013/0035009 | A1 | 2/2013 | Kuriyagawa et al. | |
| 2013/0047957 | A1 | 2/2013 | Breuer et al. | |
| 2014/0244130 | A1 | 8/2014 | Filev et al. | |
| 2015/0000636 | A1 | 1/2015 | Stockbridge et al. | |

OTHER PUBLICATIONS

U.S. Appl. No. 14/284,795, filed May 22, 2014.
U.S. Appl. No. 14/104,291, filed Dec. 12, 2013.
Arbuckle et al., "Systems and Methods for Setting Engine Speed in a Marine Propulsion Device", Unpublished U.S. Appl. No. 14/610,377, filed Jan. 30, 2015.

* cited by examiner

SYSTEMS AND METHODS FOR SETTING ENGINE SPEED USING A FEED FORWARD SIGNAL

CROSS-REFERENCE TO RELATED APPLICATION

This application claims the benefit of U.S. Provisional Application Ser. No. 61/994,234, filed May 16, 2014, which is hereby incorporated by reference herein.

FIELD

The present disclosure relates to marine propulsion systems for use on marine vessels, and more specifically to systems and methods for setting an engine speed of an internal combustion engine of a marine propulsion system.

BACKGROUND

U.S. Pat. No. 8,762,022, hereby incorporated by reference herein, discloses a system and method for efficiently changing controlled engine speed of a marine internal combustion engine in a marine propulsion system for propelling a marine vessel. The system responds to the operator changing the operator-selected engine speed, from a first selected engine speed to a second-selected engine speed, by predicting throttle position needed to provide the second-selected engine speed, and providing a feed forward signal moving the throttle to the predicted throttle position, without waiting for a slower responding PID controller and/or overshoot thereof, and concomitant instability or oscillation, and then uses the engine speed control system including the PID controller to maintain engine speed at the second-selected engine speed.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure is of a method for setting an engine speed of an internal combustion engine in a marine propulsion system to an operator-selected engine speed. The method includes predicting a position of a throttle valve of the engine that is needed to provide the operator-selected engine speed and determining a feed forward signal that will move the throttle valve to the predicted position. After moving the throttle valve to the predicted position, the method next includes controlling the engine speed with a feedback controller so as to obtain the operator-selected engine speed. The feed forward signal is determined based on at least one of the following criteria: an operator-selected control mode of the marine propulsion system; and an external operating condition of the marine propulsion system.

Another example of the present disclosure is of a marine propulsion system comprising an internal combustion engine having a throttle valve and an input device for inputting an operator demand corresponding to an operator-selected engine speed. An electronic control unit predicts a position of the throttle valve that will provide the operator-selected engine speed and that determines a feed forward signal that will move the throttle valve to the predicted position. A feedback controller controls the engine speed so as to obtain the operator-selected engine speed after the throttle valve has been moved to the predicted position. According to the present disclosure, the electronic control unit determines the feed forward signal based on at least one of the following criteria: an operator-selected control mode of the marine propulsion system; and an external operating condition of the marine propulsion system.

BRIEF DESCRIPTION OF THE DRAWINGS

The present disclosure is described with reference to the following figures. The same numbers are used throughout the figures to reference like features and like components.

DETAILED DESCRIPTION

In the present description, certain terms have been used for brevity, clarity, and understanding. No unnecessary limitations are to be inferred therefrom beyond the requirement of the prior art because such terms are used for descriptive purposes only and are intended to be broadly construed.

PRIOR ART

Figure 1:
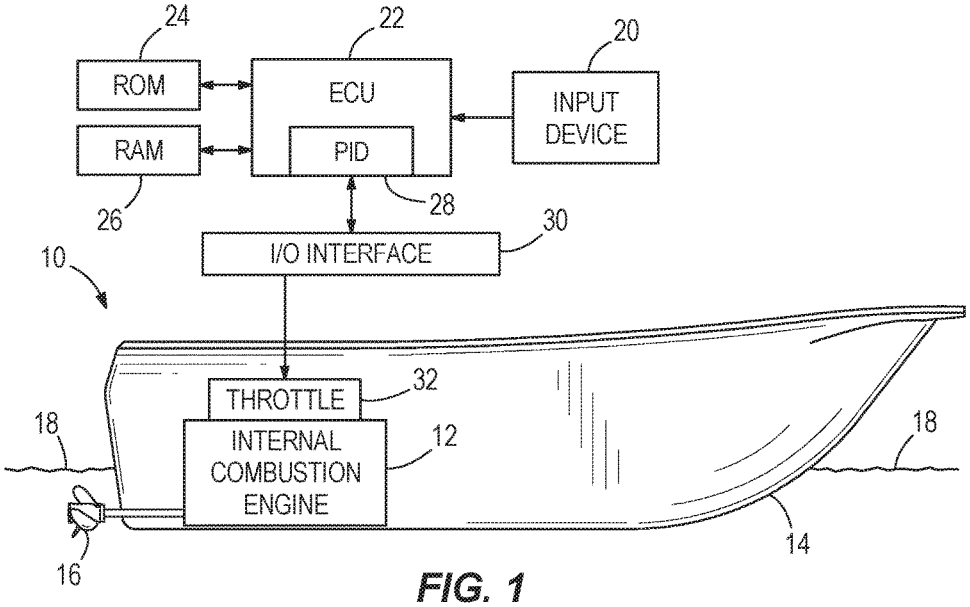
FIG. 1 PRIOR ART
FIG. 1 is a schematic illustration of marine propulsion system known in the prior art.

FIG. 1 shows a marine propulsion system 10 having an internal combustion engine 12 for propelling a marine vessel 14, e.g. by way of propeller 16, in a body of water 18. Engine speed is set by the operator of the marine vessel 14 by using an input device 20, such as a throttle lever, joystick, or the like to input an operator demand. An electronic control unit (ECU) 22 receives the engine speed command from the input device 20 and includes appropriate read only memory (ROM) 24 and random access memory (RAM) 26 and a processor for interpreting the engine speed command and processing it with a proportional integral derivative (PID) feedback controller 28. Feedback controller 28 outputs a control signal to input-output (I/O) interface 30, which in turn supplies a control signal to internal combustion engine 12, including throttle valve 32.

By way of control with the feedback controller 28, the ECU 22 maintains engine speed at the operator-selected engine speed. The engine 12 has the noted throttle valve 32, which controls engine speed according to throttle position.

In response to the operator changing the operator-selected engine speed at input device 20 from a first-selected engine speed to a second-selected engine speed (i.e. a change or delta), the ECU 22 sends a signal to move the throttle valve 32 to a new position to attempt to set the engine speed to the noted second-selected engine speed. However, this type of system is subject to overshoot, particularly at large deltas, when attempting to set engine speed to the second-selected engine speed in response to the noted change by the operator of the selected engine speed at input device 20. To accommodate various deltas, including large deltas, the feedback controller 28 is provided with enough amplification gain to provide a desired response time to accommodate the change in the first-selected engine speed to the second-selected engine speed at input device 20. The higher the amplification gain, the quicker the response time; however, higher gain makes the system subject to more overshoot and instability.

PRESENT DISCLOSURE

Figure 2:
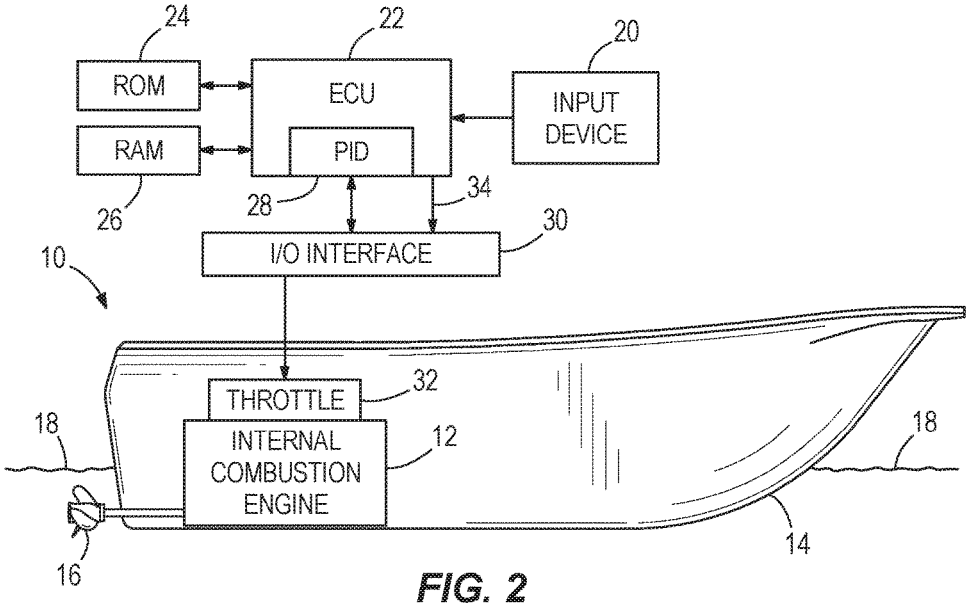
FIG. 2 is like FIG. 1, but shows a marine propulsion system according to the present disclosure.

Referring to FIG. 2, in the present system, in response to the operator changing the operator-selected engine speed at input device 20 from a first-selected engine speed to a second-selected engine speed, a prediction is made as to the position of the throttle valve 32 needed to provide the second-selected engine speed. A feed forward signal is then provided at 34, which feed forward signal bypasses feedback controller 28, and moves throttle valve 32 to the predicted throttle valve position. After movement of the throttle valve 32 to the predicted throttle valve position, the feedback controller 28 corrects the position of the throttle valve 32 as needed so as to obtain and maintain the engine speed at the second operator-selected engine speed. Throttle valve 32 is therefore moved to the predicted throttle position in response to the feed forward signal at 34, without waiting for the input of the feedback controller 28 to move the throttle valve 32, thereby decreasing or eliminating any overshoot otherwise caused by the system. The system of FIG. 2 thereby enables reduction of the amplification gain of the feedback controller 28 otherwise needed to accommodate the change or delta from the first-selected engine speed to the second-selected engine speed at input device 20, and instead accommodates such change or delta by the predicted throttle position provided by the feed forward signal 34. The feedback controller amplification gain need only be large enough to maintain engine speed at the second-selected engine speed, without having to accommodate the change or delta from the first-selected engine speed to the second-selected engine speed. The reduced amplification gain provides enhanced stability of the feedback controller 28 and reduces oscillation of the system.

FIG. 2 therefore depicts a marine propulsion system 10 comprising an internal combustion engine 12 having a throttle valve 32 and an input device 20 for inputting an operator demand corresponding to an operator-selected engine speed. An electronic control unit 22 predicts a position of the throttle valve 32 that will provide the operator-selected engine speed and determines a feed forward signal 34 that will move the throttle valve 32 to the predicted position. A feedback controller 28 in the ECU 22 controls the engine speed so as to obtain the operator-selected engine speed after the throttle valve 32 has been moved to the predicted position. However, the above-described benefits regarding using the feed forward signal to accommodate a large change or delta without requiring a lot of adjustment from the feedback controller 28 are only as good as the feed forward signal and corresponding predicted throttle position. According to the present disclosure, therefore, the ECU 22 determines the feed forward signal 34 based on at least one of the following criteria: (a) an operator selected control mode of the marine propulsion system 10, and (b) an external operating condition of the marine propulsion system 10.

Now turning to FIG. 3, an embodiment of the system 10 in which the ECU 22 gradually adapts the feed forward signal 34 so as to more accurately predict the position of the throttle valve 32 that will achieve the operator-selected engine speed when an external operating condition is present will be described. As shown at box 36, an operator demand (helm demand) is input, for example by the operator of the marine vessel 14 manipulating input device 20. In one example, the input device 20 is a throttle lever, and the helm demand corresponds to an angular position of the throttle lever as measured by a potentiometer. The helm demand is sent to box 38, where a lookup table (or similar input-output map) returns an operator-selected engine speed (engine speed setpoint) based on the helm demand. This lookup table is pre-calibrated based on a typical speed versus load curve and is generally independent of the engine, boat, gear ratio, and propeller combination. The engine speed setpoint is then sent to a first summer 42. As shown at box 40, the engine speed setpoint is also used to determine the feed forward signal (for example by way of another lookup table), which feed forward signal 34 corresponds to a particular predicted position of the throttle valve 32. The feed forward signal 34 is then provided to a second summer 44, bypassing feedback controller 28. During a first iteration, the output of second summer 44 is simply the feed forward signal 34, which is provided to the engine 12 to move the throttle valve 32 to the predicted position, as shown at box 46.

As shown at box 48, the actual engine speed is measured, for example using a tachometer, and this value is provided to the first summer 42. The first summer 42 compares the engine speed setpoint from box 38 with the actual engine speed from box 48, and a difference between the two is sent to the feedback controller 28. As shown at box 50, the feedback controller 28 generates a PID output on the feedback regarding the engine speed setpoint versus the actual engine speed. The PID output from box 50 is summed with the feed forward signal 34 from box 40 at second summer 44, and this summed signal now dictates the position of the throttle valve 32, as shown at box 46. In this way, if the predicted position of the throttle valve 32 (based solely on feed forward signal 34) has not resulted in the actual engine speed reaching the operator-selected engine speed, the feedback controller 28 can adjust the position of the throttle valve 32 to obtain the operator-selected engine speed. The predicted position of the throttle valve 32 might not result in the operator-requested engine speed immediately due to the inexactness of a calibrated predicted throttle position, or due to external conditions acting on the marine propulsion system 10 that cause the vessel speed not to follow the standard calibrated speed versus load curve, such as a heavy load on the system 10, an age of the engine 12, a barometric pressure of the surrounding atmosphere, characteristics of the propeller 16, or any other condition that consistently affects the ability of the predicted throttle position as calibrated to achieve a particular engine speed. Under steady-state conditions, the feedback controller 28 is able to stabilize the system 10 at the operator-selected engine speed, which may require some iteration of movement of the throttle valve 32 and subsequent comparison of the resulting actual engine speed to the operator-requested engine speed. The feedback controller 28 also continues to work to maintain the engine speed at the operator-selected engine speed despite changing external circumstances or conditions.

Figure 3:
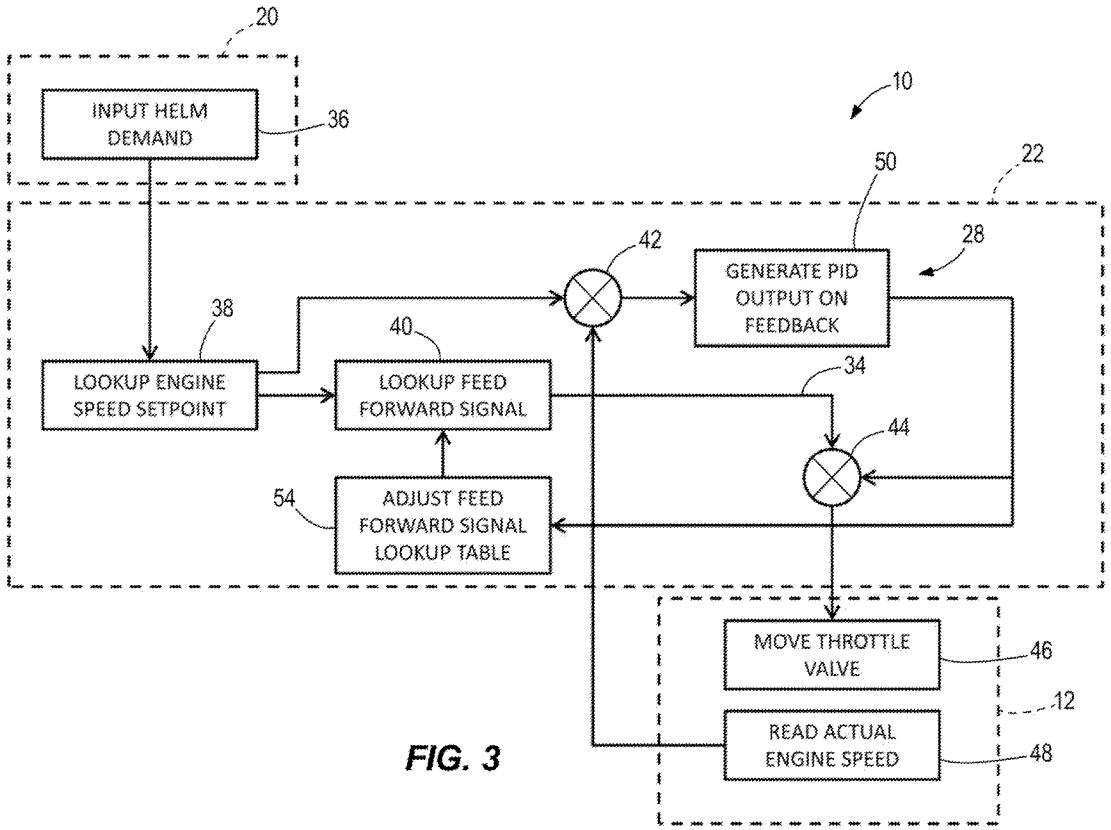
FIG. 3 is a schematic circuit diagram according to one example of the present disclosure.

In the example of FIG. 3, the system includes a further advantage, in that the feed forward signal 34 can be gradually "adapted" so as to more accurately predict the position of the throttle valve 32 that will achieve the operator-selected engine speed when a particular external operating condition is present. In one example, the output of the feedback controller 28 can be utilized to adapt the feed forward signal 34 so as to gradually drive the output of the feedback controller 28 to zero. Doing so can account for an external operating condition of the marine propulsion system 10, such that when then marine propulsion system 10 encounters a similar condition at a later time, the ECU 22 will better be able to predict the feed forward signal 34 needed to bring the speed of the engine 12 to the operator-selected engine speed despite the external operating condition. As the predicted throttle position becomes more accurate over time, less adjustment will be required from the feedback controller 28, and its output will gradually be driven to zero, even when the external operating condition is present. In one example, the feed forward signal 34 is only adapted when the marine propulsion system 10 is operating at steady state conditions and/or when the external operating condition is present.

According to the example of FIG. 3, the feed forward signal 34 may be adapted by adjusting the feed forward signal look up table, as shown at box 54. For example, the ECU 22 might be calibrated during setup of the system 10 such that its feed forward signal lookup table (see box 40) indicates that an operator-selected engine speed of 4,000 RPM corresponds to 80% throttle. Without adaptation of the feed forward term, every time the user requested 4,000 RPM, the throttle valve 32 would be moved to a predicted position corresponding to 80% throttle. If due to a particular external operating condition of the marine propulsion system 10, only 70% throttle was needed to achieve 4,000 RPM, the feedback controller 28 would need to take out the extra 10% throttle to achieve the operator-selected engine speed. The feedback controller 28 would need to do this every time the operator requested 4,000 RPM and the particular operating condition was present, resulting in inefficiency of the system 10. By adjusting the feed forward signal lookup table to map an operator-requested engine speed of 4,000 RPM to 70% throttle instead of the calibrated 80%, a more accurate first-time prediction of the position of the throttle valve 32 can be provided. Little or no adjustment by the feedback controller 28 would be required due to this more accurate predicted position of the throttle valve that accounts for the presence of the external operating condition. In one example, this allows an engine that has been placed on a barge to adjust a calibrated predicted position of the throttle valve 32 across all engine speeds to account for the great weight of the barge and resulting load it places on the marine propulsion system 10.

In one example, the system 10 accomplishes this adaptation of the feed forward signal by providing a feedback loop that adjusts the I-term of the PID feedback controller 28. During each successive iteration of control over the position of the throttle valve 32 while the external operating condition is present, a small fraction of the I-term output from the feedback controller 28 is either added to or subtracted from the feed forward signal 34, depending on whether the throttle valve 32 needs to open or close to achieve the operator-selected engine speed. Continuing the example above, in which the I-term corresponds to a 10% difference in the required throttle, a fraction of the 10% difference could be subtracted from the feed forward signal corresponding to 80% throttle during each iteration of control. In other words, after one iteration of control, the feed forward signal would adapt to 79%. The I-term output from the feedback controller 28 would then only need to be minus 9% in order to achieve the total required 70% throttle. Because the throttle valve's position would still need to be adjusted by the feedback controller 28 to achieve the 70%, another fraction of the I-term could be subtracted from the feed forward signal. In the next iteration, the feed forward signal would adapt to 78% and the I-term output from the feedback controller 28 would drop to minus 8%. These iterations would continue such that the output of the feedback controller 28 is driven to zero. At that time, the feed forward signal 34 will correspond to the 70% throttle that is needed to achieve 4,000 RPM under the particular steady state external operating condition affecting the system. The next time the ECU 22 receives an operator request for 4,000 RPM, it can map that request directly to a feed forward signal corresponding to 70% throttle, instead of the originally-calibrated 80%. In this manner, the feed forward signal can become, and remain, more accurate over the life of the engine 12.

In one example, the feed forward signal lookup table itself is adjusted in order to accomplish the above-described adaptation. In another example, the feed forward signal lookup table remains the same, but a second lookup table is provided that contains an adapt term that successively increases or decreases by a fractional amount of the I-term. The output of this second table would be added to the feed forward term from the first table, and in turn both would be added to the output from the feedback controller 28 to achieve the operator-selected engine speed. Using the last iteration of the example above, the feed forward lookup table would output the calibrated 80%, the adapt term table would output minus 2%, and the I-term would be minus 8%.

The system of the present disclosure may also limit an amount by which the feed forward signal 34 can be adapted. In one example, the amount by which the feed forward signal can be adapted is based on an operator input to the marine propulsion system 10, such as an operator demand input corresponding to a position of a throttle lever. One example of when this is particularly desirable is when an operator is nearing a full throttle request via the input device 20. For example, say the helm demand is at 80%, and the corresponding feed forward signal is already nearly maxing out the speed capabilities of the engine 12 while attempting to reach the operator-selected engine speed associated with the 80% helm demand. Without any limitation on how much the feed forward signal may adapt, the ECU 22 might allow the engine 12 to operate at its peak speed even though the operator demand is only at 80% based on the position of the input device 20. In other words, 80% helm demand at the input device 20 could in fact lead to 100% of the engine's speed capabilities if there were no limits on the amount the feed forward signal could adapt. In this instance, if the operator moved the input device 20 from 80% helm demand to 100% helm demand, the speed of the engine 12 and thus of the marine vessel 14 would not be able to increase, and the input device 20 would be in a dead zone. If the operator then pulled back on the input device 20 from 100% to 80%, the operator would experience the same effect in reverse, as the decreased helm demand would not result in decreased engine speed until the input device 20 requested a demand below the exemplary 80% helm demand threshold. Limiting the adaptation of the feed forward signal thus helps the system 10 to avoid wind up and to function well even when the marine vessel 14 is underpropped or heavily loaded.

Figure 4:
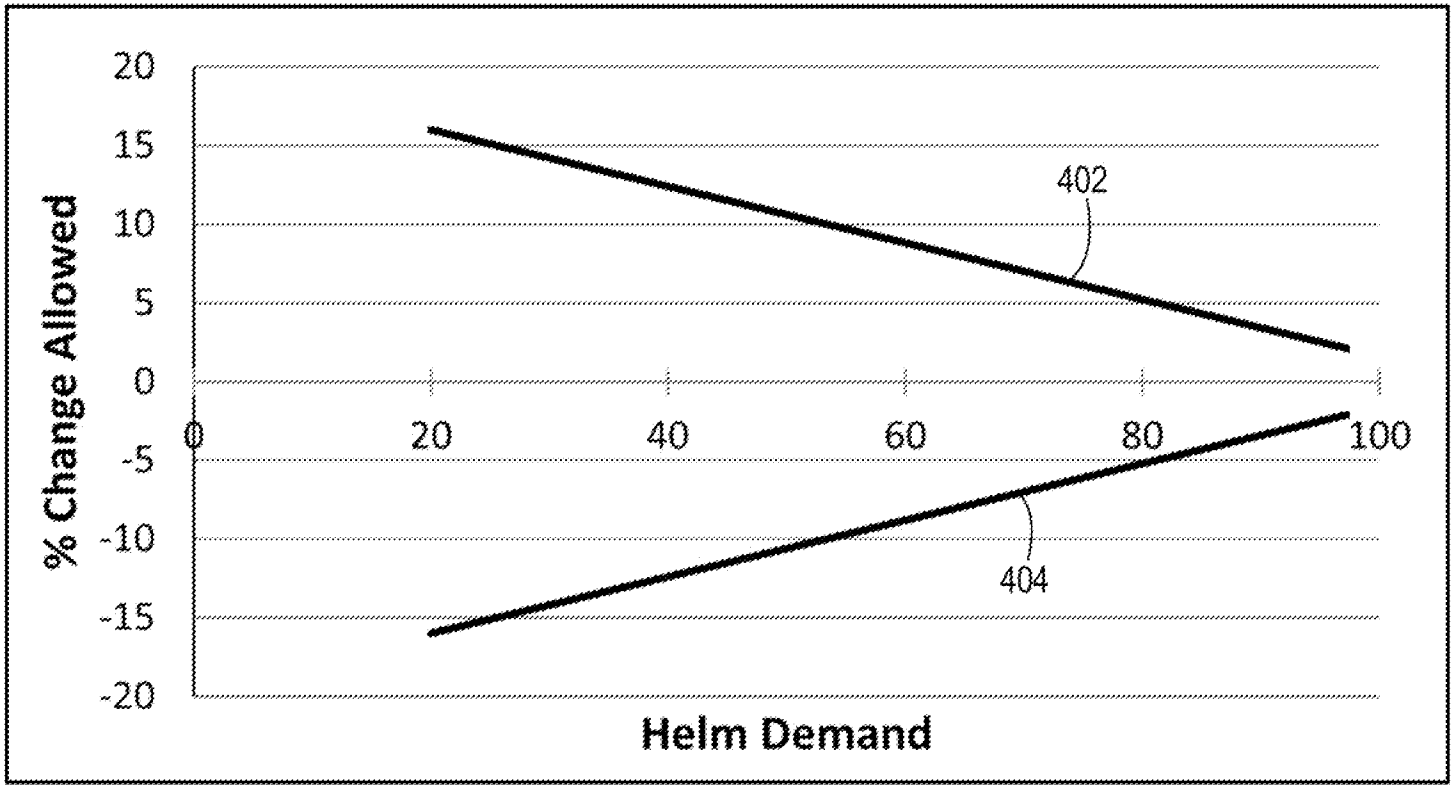
FIG. 4 shows one example of a chart containing limits on adaptation of a feed forward signal according the present disclosure.

Turning now to FIG. 4, an example of how the adaptation of the feed forward signal 34 may be limited is shown in the form of a limits chart. The limits shown in this chart are applied to the change allowed to the throttle percentage and are therefore applied to the amount of adaptation added to the feed forward signal. In another example, the limits could act on the overall feed forward signal itself, i.e., after the adapt value has been added to the feed forward signal. The exemplar), chart has an x-axis of helm demand and a y-axis of allowed change in throttle percentage. A maximum limit on how much the throttle percentage may increase is represented by line 402 and a minimum limit on how much the throttle percentage may decrease is represented by line 404. It can be seen from FIG. 4 that the amount by which the feed forward signal can be adapted decreases as the operator demand increases, as both the limit lines 402, 404 converge toward one another as helm demand increases. For example, when the helm demand is 20%, the position of the throttle could be adapted by ±16% in order to achieve the operator-selected engine speed. As the helm demand increases toward 100%, the limits on the allowed change in throttle decrease to about ±2%.

It should be noted that the exact values shown in FIG. 4 are for exemplary purposes only and are not limiting on the scope of the present claims. Further, in another example, the x-axis of the limits chart may be operator-selected engine speed. In yet another example, the limits are determined from a lookup table or other similar input-output map, rather than from a chart.

Continuing the example from above, limiting the adaptation of the feed forward signal 34 ensures that an 80% helm demand cannot be mapped to 100% throttle. In the exemplary table of FIG. 4, at 80% helm demand the feed forward signal is allowed to adapt to a total of only ±5% throttle. Although this may prevent the engine speed from achieving the operator-requested engine speed, it lessens or eliminates the problem of the input device dead zone, as it leaves room for ±15% change in throttle upon subsequent movement of the input device 20 beyond the 80% helm demand position. Where the engine speed is not approaching its maximum capabilities, i.e. at lesser helm demands, the dead zone is not a consideration and more adaptation of the feed forward signal is allowed.

Figure 5:
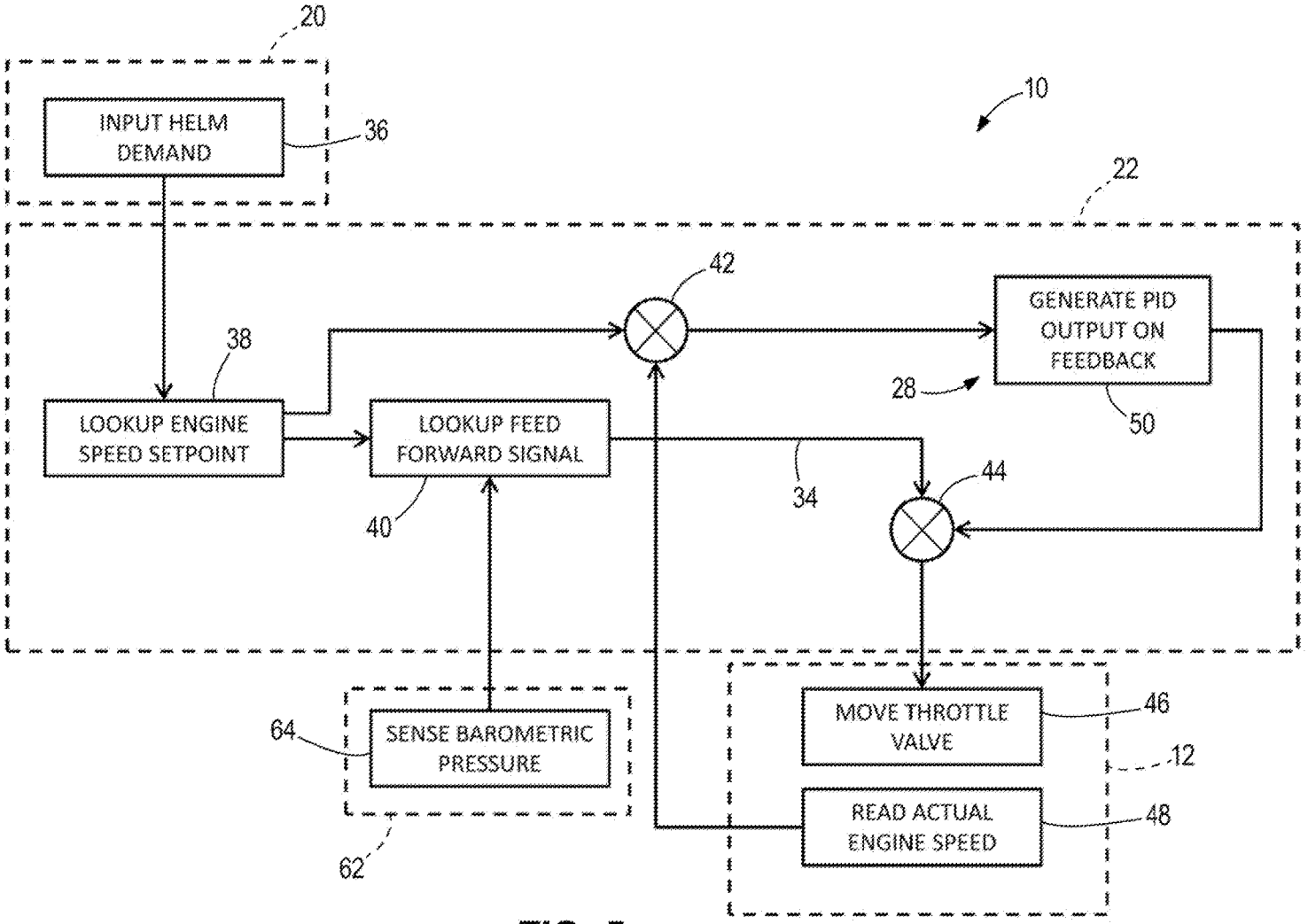
FIG. 5 is a schematic circuit diagram according to another example of the present disclosure.

FIG. 5 illustrates another embodiment of the marine propulsion system 10 according the present disclosure. As in FIG. 3, a user inputs a helm demand at box 36 by way of the input device 20. The engine speed setpoint is thereafter determined at box 38, and this setpoint is sent to box 40 where the feed forward signal is looked up. The feed forward signal, however, is now also based on another input representing an external operating condition of the marine propulsion system 10: barometric pressure. The system 10 in FIG. 5 is provided with a barometric pressure sensor 62 for determining a barometric pressure of an atmosphere in which the marine propulsion system 10 is operating. In another example, the barometric pressure may be input by the operator of the marine vessel 14. At box 64, the barometric pressure is input to the feed forward signal lookup table at box 40. A feed forward signal 34 that is based on the engine speed setpoint and the barometric pressure is thereafter output to a summer 44, as described with reference to FIG. 3.

The remainder of the system 10 in FIG. 5 operates similarly to the system of FIG. 3 described above. However, when the throttle valve is moved at box 46, it is now moved according to a feed forward signal that is based on the barometric pressure surrounding the marine propulsion system 10. When at altitude, a given predicted position of the throttle valve 32 (which given position is not calibrated for that altitude) will not be able to achieve the operator-requested engine speed, and the throttle valve 32 will need to be opened more via control with the feedback controller 28 to achieve the same amount of torque for a given RPM. The system of FIG. 5 considerably reduces taxing of the feedback controller 28, which otherwise would need to make up for the extra torque required to achieve a particular engine speed. In one example, the feed forward signal 34 is read from a modified feed forward lookup table (or similar input-output map) that accepts the barometric pressure and the engine speed setpoint as inputs, and outputs a throttle percentage corresponding to a particular position of the throttle valve 32. Additionally, the lookup table may include values that keep the throttle feel of the system 10 linear in the region where the marine vessel 14 transitions from off to on-plane. This allows the system 10 to compensate for the fact that even though the amount of torque required to get a marine vessel 14 on-plane remains constant regardless of altitude, the amount of air to make that torque changes relative to altitude.

Figure 6:
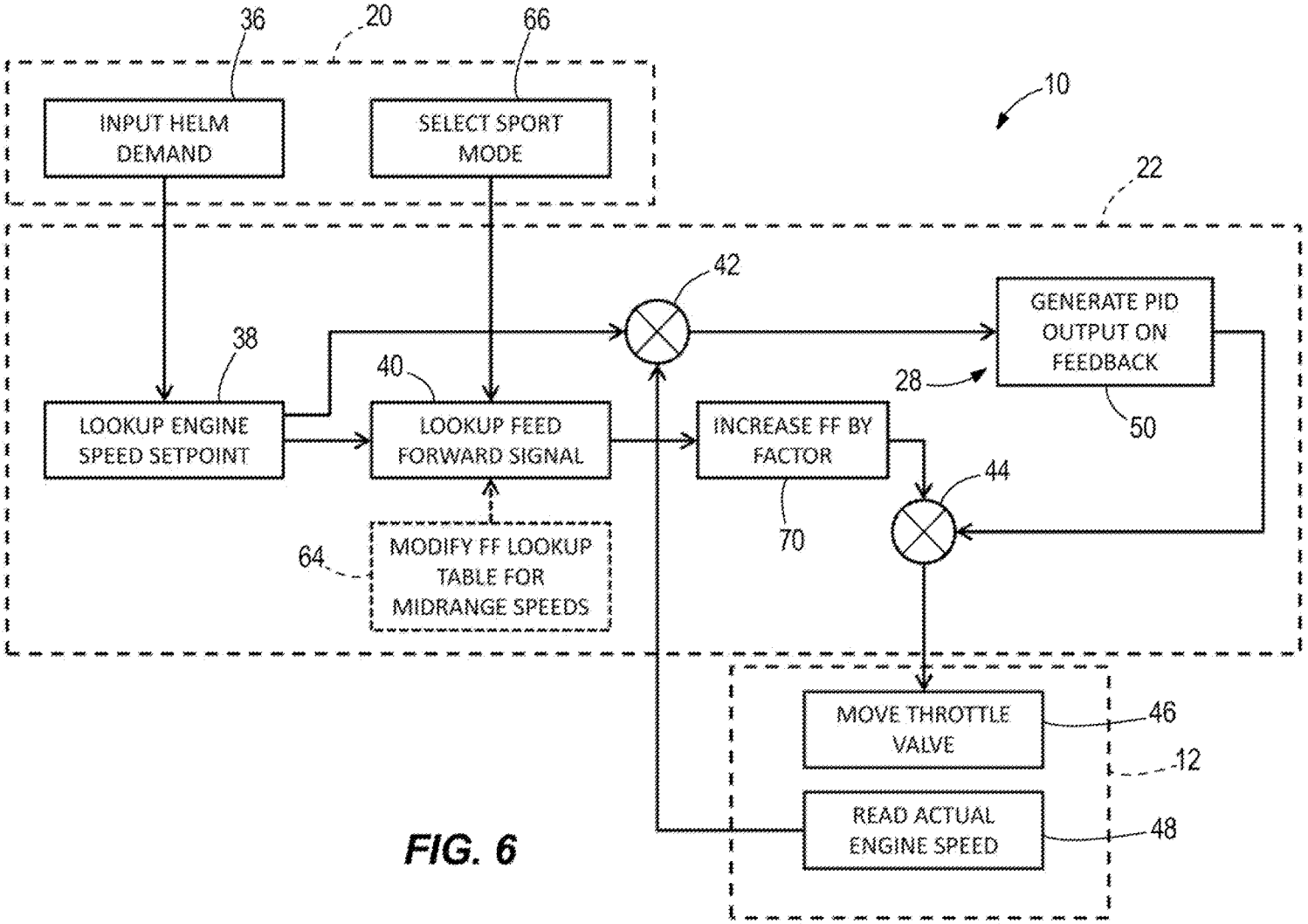
FIG. 6 is a schematic circuit diagram according to another example of the present disclosure.

Now turning to FIG. 6, a system in which the operator-selected control mode comprises a sport mode will be described. This system 10 comprises a sport mode input device, for example shown at box 66, which may optionally be provided at or as part of input device 20. The sport mode input device 66 may comprise one or more push buttons, an interactive touch screen, or any other similar input device. The sport mode input device 66 allows an operator to select a desired aggressiveness of acceleration of the engine speed when the operator-selected engine speed is between a lower engine speed threshold and an upper engine speed threshold. This provides increased aggressiveness of acceleration in midrange speeds, while leaving acceleration at low range speeds and high range speeds the same. In one example, the low range speed is an idle speed of between 550 RPM and 1100 RPM, while the high range speed is about 4500 RPM and greater.

The sport mode input device 66 may also allow a user to select a factor or exponent by which he would like to increase the aggressiveness of acceleration. In one example, the operator's input modifies the feed forward look up table for midrange speeds, as shown at box 68. In another example, an un-modified feed forward lookup table is utilized at box 40, but the feed forward signal output from box 40 is increased by a factor or an exponent as shown at box 70. This second example eliminates the need for an entirely different feed forward table to be used when sport mode is selected (compare box 68). In another example, the throttle feel may be based off a third or fourth order equation that maps helm demand to RPM setpoint. The sport mode input device 66 could be used to change the exponents of the equation. The remainder of the system 10 will operate according to the description provided above with regards to FIG. 3, with the understanding that the feed forward signal that is added to the PID output at summer 44 is based on a selected aggressiveness of acceleration input by the operator.

It should be understood that for each of the figures described above, the systems described could be combined such that the feed forward signal 34 is adapted even after it has been determined according to selection of a sport mode and/or based on a barometric pressure.

Figure 7:
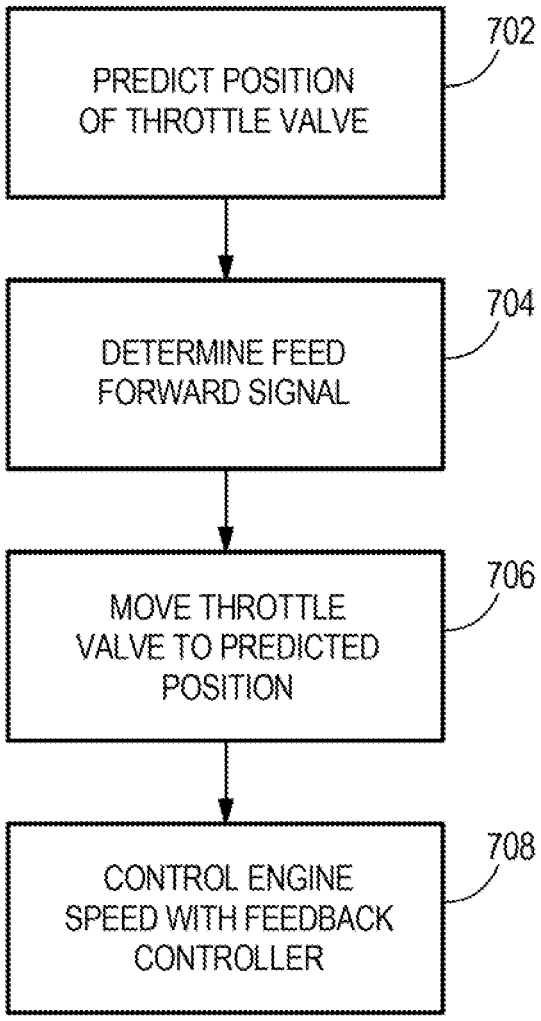
FIG. 7 is a flow chart showing a method according to the present disclosure.

Now turning to FIG. 7, a method for setting an engine speed of an internal combustion engine 12 of a marine propulsion system 10 to an operator-selected engine speed will be described. The method comprises, as shown at 702, predicting a position of a throttle valve 32 of the engine 12 that is needed to provide the operator-selected engine speed. As shown at 704, the method next comprises determining a feed forward signal that will move the throttle valve 32 to the predicted position. Next, as shown at 706, the method comprises moving the throttle valve to the predicted position. As shown at 708, the method then includes controlling the engine speed with a feedback controller so as to obtain the operator-selected engine speed after having moved the throttle valve 32 to the predicted position. The feed forward signal 34 according to the above method is determined based on at least one of the following criteria: an operator-selected control mode of the marine propulsion system 10 and an external operating condition of the marine propulsion system 10.

Referring back to FIG. 3, the method may further comprise gradually adapting the feed forward signal 34 so as to more accurately predict the position of the throttle valve 32 that will achieve the operator-selected engine speed when the external operating condition is present. The method may also comprise limiting an amount by which the feed forward signal 34 can be adapted based on an operator input to the marine propulsion system 10. In one example, the amount by which the feed forward signal can be adapted decreases as an operator demand input increases. (See FIG. 4.) The method may also further comprise utilizing an output of the feedback controller 28 to adapt the feed forward signal 34 so as to gradually drive the output of the feedback controller 28 to zero.

In one example, the external operating condition comprises a load on the marine propulsion system 10. In another example, the external operating condition comprises a barometric pressure of an atmosphere in which the marine propulsion system 10 is operating. In the latter example, the feed forward signal 34 can be based on an adapted value determined after the marine vessel 14 has operated at a different altitude for a while, and/or a value determined from a pre-calibrated lookup table that accepts the barometric pressure and the operator-selected engine speed as inputs. (See FIG. 5.)

In one example, the operator-selected control mode comprises a sport mode in which an operator may select a desired aggressiveness of acceleration of the engine speed. In this example, the method may further comprise increasing the feed forward signal 34 by an operator-selected factor when the operator-selected engine speed is between a lower engine speed threshold and an upper engine speed threshold and the sport mode is selected. (See FIG. 6.)

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A method for setting an engine speed of an internal combustion engine in a marine propulsion system to an operator-selected engine speed, wherein a feedback controller maintains the engine speed at the operator-selected engine speed, the method comprising:

predicting a position of a throttle valve of the engine that is needed to provide the operator-selected engine speed;

determining a feed forward signal that will move the throttle valve to the predicted position based on an external operating condition of the marine propulsion system;

providing the feed forward signal to the throttle valve, bypassing the feedback controller, to move the throttle valve to the predicted position;

after moving the throttle valve to the predicted position, controlling the engine speed with the feedback controller so as to obtain the operator-selected engine speed; and adapting the feed forward signal by iteratively adding or subtracting a fraction of an integral term output by the feedback controller so as to more accurately predict the position of the throttle valve that is needed to provide the operator-selected engine speed when the external operating condition is present.

2. The method of claim 1, further comprising limiting an amount by which the feed forward signal can be adapted based on an operator input to the marine propulsion system.

3. The method of claim 2, wherein the amount by which the feed forward signal can be adapted decreases as an operator demand input increases.

4. The method of claim 1, further comprising adapting the feed forward signal so as to drive the integral term output by the feedback controller to zero.

5. The method of claim 1, wherein the external operating condition comprises a load on the marine propulsion system.

6. The method of claim 1, further comprising determining the feed forward signal that will move the throttle valve to the predicted position based on an operator-selected control mode of the marine propulsion system, wherein the operator-selected control mode comprises a sport mode in which an operator may select a desired aggressiveness of acceleration of the engine speed.

7. The method of claim 6, further comprising increasing the feed forward signal by an operator-selected factor when the operator-selected engine speed is between a lower engine speed threshold and an upper engine speed threshold and the sport mode is selected.

8. The method of claim 1, wherein the external operating condition comprises a barometric pressure of an atmosphere in which the marine propulsion system is operating.

9. The method of claim 8, further comprising inputting the barometric pressure and the operator-selected engine speed into a pre-calibrated lookup table to determine the feed forward signal.

10. A marine propulsion system comprising:

an internal combustion engine having a throttle valve;

an input device for inputting an operator demand corresponding to an operator-selected engine speed;

an electronic control unit that predicts a position of the throttle valve that will provide the operator-selected engine speed and that determines a feed forward signal that will move the throttle valve to the predicted position; and a feedback controller that controls a speed of the engine so as to obtain the operator-selected engine speed after the throttle valve has been moved to the predicted position;

wherein the electronic control unit determines the feed forward signal based on an external operating condition of the marine propulsion system;

wherein the electronic control unit adapts the feed forward signal by iteratively adding or subtracting a fraction of an integral term output by the feedback controller so as to more accurately predict the position of the throttle valve that is needed to provide the operator-selected engine speed when the external operating condition is present; and wherein the electronic control unit provides the feed forward signal to the throttle valve, bypassing the feedback controller, to move the throttle valve to the predicted position.

11. The marine propulsion system of claim 10, wherein the electronic control unit limits an amount by which the feed forward signal can be adapted based on the operator demand.

12. The marine propulsion system of claim 11, wherein the amount by which the feed forward signal can be adapted decreases as the operator demand increases.

13. The marine propulsion system of claim 10, wherein the external operating condition comprises a load on the marine propulsion system.

14. The marine propulsion system of claim 10, wherein the electronic control unit determines the feed forward signal based on an operator-selected control mode of the marine propulsion system, and wherein the operator-selected control mode comprises a sport mode.

15. The marine propulsion system of claim 14, further comprising a sport mode input device, wherein when the operator-selected engine speed is between a lower engine speed threshold and an upper engine speed threshold, actuation of the sport mode input device allows an operator to select a desired aggressiveness of acceleration of the engine speed.

16. The marine propulsion system of claim 10, further comprising a barometric pressure sensor for determining a barometric pressure of an atmosphere in which the marine propulsion system is operating, wherein the external operating condition comprises the barometric pressure.

17. The marine propulsion system of claim 16, wherein the electronic control unit determines the feed forward signal based on the barometric pressure and the operator-selected engine speed.

* * * * *